US008288964B2

(12) United States Patent
Hente et al.

(10) Patent No.: US 8,288,964 B2
(45) Date of Patent: Oct. 16, 2012

(54) MIRROR FOR PERSONAL USE WITH USER POSITION DEPENDENT ILLUMINATION

(75) Inventors: Dirk Hente, Wuerselen (DE); Martin Christoph, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 308 days.

(21) Appl. No.: 12/747,174

(22) PCT Filed: Dec. 11, 2008

(86) PCT No.: PCT/IB2008/055224

§ 371 (c)(1),
(2), (4) Date: Jun. 10, 2010

(87) PCT Pub. No.: WO2009/077946

PCT Pub. Date: Jun. 25, 2009

(65) Prior Publication Data

US 2010/0270953 A1 Oct. 28, 2010

(30) Foreign Application Priority Data

Dec. 17, 2007 (EP) ..... 07123336

(51) Int. Cl.
*H05B 37/02* (2006.01)
*H01J 1/62* (2006.01)

(52) U.S. Cl. ..... 315/309; 362/97.1; 362/135; 362/800

(58) Field of Classification Search ..... 315/309, 315/294, 295, 297, 307, 313; 362/97.1, 97.4, 362/135, 140–142, 800
See application file for complete search history.

(56) References Cited

U.S. PATENT DOCUMENTS 6,910,779 B2 6/2005 Abel et al.
2004/0140961 A1 * 7/2004 Cok ..... 345/175
2005/0135087 A1 6/2005 Mita et al.
(Continued)

FOREIGN PATENT DOCUMENTS

DE 202004000369 U1 5/2005
(Continued)

OTHER PUBLICATIONS

Leske, N.: "Gadgets At IFA Promise Simpler, More Beautiful Life"; Article on IFA Consumer Fair, Downloaded From Yahoo AThttp://news.yahoo.com/s/nm/20070903/tc_nm/electronics_fair_gadgets_de;_ylt=A0W, on Sep. 25, 2007. 3 Page Document.

(Continued)

*Primary Examiner* — Daniel D Chang
(74) *Attorney, Agent, or Firm* — Mark L. Beloborodov

(57) ABSTRACT

The invention relates to a mirror for personal use, with a lighting system for illuminating at least part of a person (9) being situated in front of the mirror. According to the invention, a position detector for detecting the position of the person (9) in front of the mirror is provided. Further, the lighting system comprises multiple lighting elements which can be actuated independently from each other in dependence of the signal of the position detector. It is especially preferred that the mirror is comprised of an array (8) of OLEDs (1) which can be selectively actuated to function as a mirror element or as a lighting element, respectively, in dependence of the position of the person (9) in front of the mirror. Further, it is preferred that these OLEDs (1) also act as capacitive proximity sensors for the position detector. Thus, a versatile mirror with a good mirror image without blinding is provided.

5 Claims, 2 Drawing Sheets

U.S. PATENT DOCUMENTS

2010/0231528 A1* 9/2010 Wolfe et al. ..... 345/173

FOREIGN PATENT DOCUMENTS

| | | | |
|---|---|---|---|
| EP | 1792553 | A2 | 6/2007 |
| WO | 2003024269 | A1 | 3/2003 |
| WO | 2004084683 | A1 | 10/2004 |
| WO | 2005071656 | A1 | 8/2005 |
| WO | 2005103864 | A2 | 11/2005 |
| WO | 2007029137 | A1 | 3/2007 |
| WO | 2007104729 | A2 | 9/2007 |

OTHER PUBLICATIONS

DoDevice the Gadget Devourer: Blog on Quadband GSM and How It Works in Mobile Phones, Downloaded at http://dodevice.com/s=quadband on September 25, 2007, 12 Page Document.

2007 Lighting Fair Review of the Tokyo International Exhibition Center Mar. 6-9, 2007. 5 Page Document Downloaded From http://www.shopbiz.jp/contents/news_If/50_050.phtml on Sep. 25, 2007.

* cited by examiner

MIRROR FOR PERSONAL USE WITH USER POSITION DEPENDENT ILLUMINATION

FIELD OF THE INVENTION

The invention relates to the field of mirrors for personal use, especially to the filed of mirrors for personal grooming.

BACKGROUND OF THE INVENTION

Personal grooming of humans typically includes activities which are performed in front of a mirror, such as combing and styling the hair, shaving the beard and other forms of body cosmetics. In order to provide good visibility of the countenance of the person who is using the mirror for personal grooming, it is known to provide the mirror with a lighting system for illuminating the person's face and/or body.

Often, such lighting systems comprise multiple lamps which can be operated manually. This means that the persons who are using the mirror can activate the lamps according to their personal requirements. Usually, the person will also want to activate the lamps in such a way that he or she is not blinded by the irradiated light. However, adjustments for good and clear reflection of the countenance of the person in front of the mirror without blinding are not easy to find. This means, that it is difficult to adapt such a lighting system to a person's demands in an easy way.

SUMMARY OF THE INVENTION

It is an object of the invention to provide a mirror and a method of operating the same which provide a good mirror image without blinding in a versatile way.

This object is achieved by a mirror for personal use, with a lighting system for illuminating at least part of a person being situated in front of the mirror, wherein a position detector for detecting the position of the person in front of the mirror is provided, and wherein the lighting system comprises multiple lighting elements which can be actuated independently from each other in dependence of the signal of the position detector.

Accordingly, it is an important feature of the invention, to provide a mirror that comprises such a lighting system which is controlled in dependence of the person's position in front of the mirror which is given by the signal of the position detector. This means that a lighting element of the lighting system is not only activated when a person approaches the mirror but that in dependence of the actual position of the person in front of the mirror at least two lighting elements are individually actuated.

Generally, it might be sufficient to actuate the individual lighting elements of the lighting system in dependence of the detected position of the person in front of the mirror by switching the lighting elements on and off, respectively. However, according to a preferred embodiment of the invention, the brightness of the lighting elements is controlled independently from each other and in dependence of the signal of the position detector. By controlling the brightness individually for each lighting element the advantage can be achieved that always an optimal illumination of the person and thus a clear and bright reflection can be achieved without blinding the person.

Further, according to a preferred embodiment of the invention, a detector for the brightness of ambient light is provided, and the signal of this detector is used for controlling the brightness of the lighting elements individually in such a way that optimal illumination of the person without blinding the same is achieved.

Throughout the present description and claims, "actuating" the lighting elements means switching the lighting elements on or off, respectively, and/or controlling the brightness of on-switched lighting elements from a minimum to a maximum degree of brightness. Further, when a lighting element is switched on it is considered to be "activated", when it is switched of, it is "not activated".

Generally, in the off-state, i.e. when the lighting elements are not activated, the lighting elements may have a non-reflective surface. However, according to a preferred embodiment of the invention, at least one lighting element is designed to act as a mirror element when it is not activated. It is especially preferred that all lighting elements act as mirror elements when they are not activated. This embodiment has the advantage that by switching off one or more lighting elements, not only blinding lights are avoided but an additional mirror surface is provided which enhances the reflection of the person's countenance. Especially, if the person moves sideways in front of the mirror, according to this preferred embodiment, light elements directly in front of the person can be switched off, and instead, a mirror surface occurs. Thus, it can be achieved that face to face with the person, a mirror surface is generated while the surrounding parts of the mirror are illuminated by activating the surrounding lighting elements and, thus, changing the appearance from reflective to illuminating.

Generally, the position detector can comprise different kinds of sensors and can be designed and arranged in multiple different ways. However, according to a preferred embodiment of the invention, the position detector comprises at least one proximity sensor. Further, it is especially preferred that the position detector comprises multiple proximity sensors, especially multiple capacitive proximity sensors. Such capacitive proximity sensors are well known and widely available for low costs. With such capacitive proximity sensors the position of the person in front of the mirror can be well estimated and, thus, actuation of the lighting elements can be controlled in a way that always allows for an optimum of reflection without blinding. Alternatively or additionally, the position detector comprises a video camera. Video cameras are well established for position detection, too, and thus might be used to further enhance position detection.

As already stated above, the mirror may comprise a brightness sensor for ambient light. According to a preferred embodiment of the invention, alternatively and/or additionally, the position detector comprises a brightness sensor, especially an array of brightness sensors. Such brightness sensors can be very simple and cheap products and, in generally, still provide the possibility of detection the person's position in front of the mirror.

Further, as also stated above, at least one lighting element may be designed to act as a mirror element when it is not activated. With respect to this, according to a preferred embodiment of the invention, an array of OLEDs is provided which act as lighting elements and as mirror elements, respectively. It is understood that one single OLED with segmented parts functioning each as single OLED units is also considered to be an array of OLEDs and, thus, being comprised of multiple lighting elements.

In general, an OLED (organic light emitting diode) functions as a mirror element when switched off because the cathode of a bottom emitting OLED is typically made of a highly reflective metal such as aluminum or silver. When switched on, the OLED serves as a large area light area light source. Further, when switched off, an OLED can act as a brightness sensor. Accordingly, an OLED itself can be used as a brightness sensor, e.g. for detection of ambient light for controlling the brightness of the irradiated light.

Accordingly, it is especially preferred to provide rows and columns of

OLEDs or OLED units of one common larger OLED, respectively, side by side generating a large mirror surface which can be partially or totally switched into an irradiating surface. This provides for the possibility to follow the person's movements in front of the mirror with the reflecting surface while the surrounding surface is illuminated. This way, always an optimal reflection without blinding the person can be achieved.

Generally, such OLEDs can only be used as lighting and mirror elements, respectively. However, according to a preferred embodiment of the invention, at least two of these OLEDs, preferably all of these OLEDs, are arranged as capacitive proximity sensors. Due to their design, OLEDs are sensitive for capacitive changes in their vicinity per se. This means that this embodiment provides for a very convenient and efficient way of providing a position sensor in case of an array of OLEDs for lighting and mirror purposes, respectively.

Above mentioned object is further solved by a method for operating a mirror as described before, wherein the position of the person in front of the mirror is detected, and wherein the lighting elements of the lighting are actuated in dependence of the detected position of the person in front of the mirror. For this method, it is especially preferred that such lighting elements are activated which are positioned outside the area in which the countenance of the person is to be reflected. This provides for the possibility of optimum and full reflection of the person's countenance without blinding.

BRIEF DESCRIPTION OF THE DRAWINGS

These and other aspects of the invention will be apparent from and elucidated with reference to the embodiments described hereinafter.

In the drawings:

FIG. 1 depicts a cross sectional view of the configuration of an

OLED used for a mirror according to a preferred embodiment of the invention.

DETAILED DESCRIPTION OF EMBODIMENTS

Figure 1:
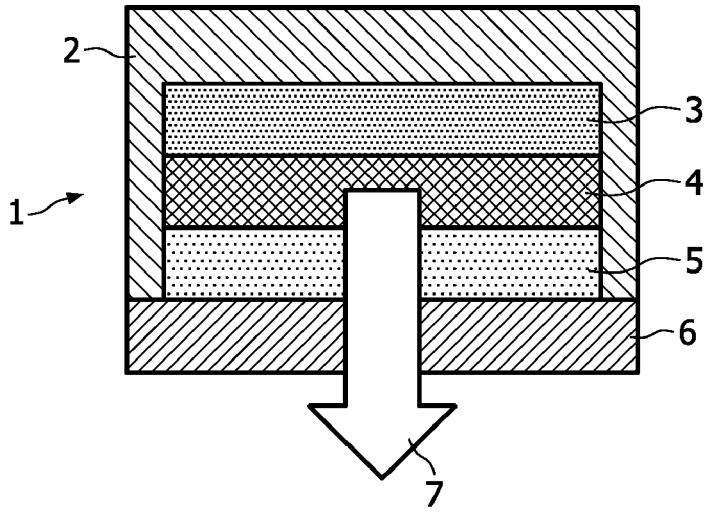

As can be seen from FIG. 1, an OLED 1 used for a mirror according to the preferred embodiment of the invention comprises, from top to bottom, a sealing 2, a cathode 3, an active layer 4 and an anode 5. This stack is arranged on a substrate 6, like a glass plate. Light 7 can be emitted through the bottom which is formed by the glass plate. The cathode 3 is typically made of a metal like aluminum or silver so that it is reflective and acts as a mirror when the OLED 1 is not activated, i.e. is not switched on and does not emit light 7.

Figure 2:
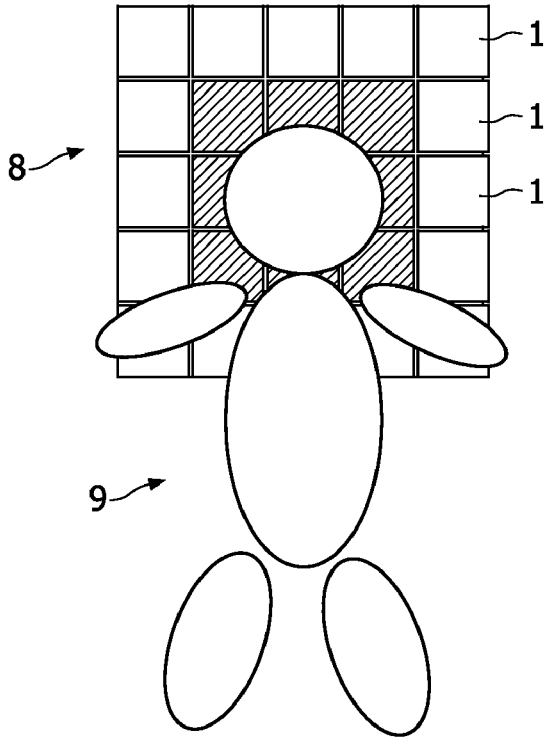
FIGS. 2 to 4 depict schematic views of a mirror according to the preferred embodiment of the invention for differently positioned or sized persons in front of the mirror.
Figure 3:
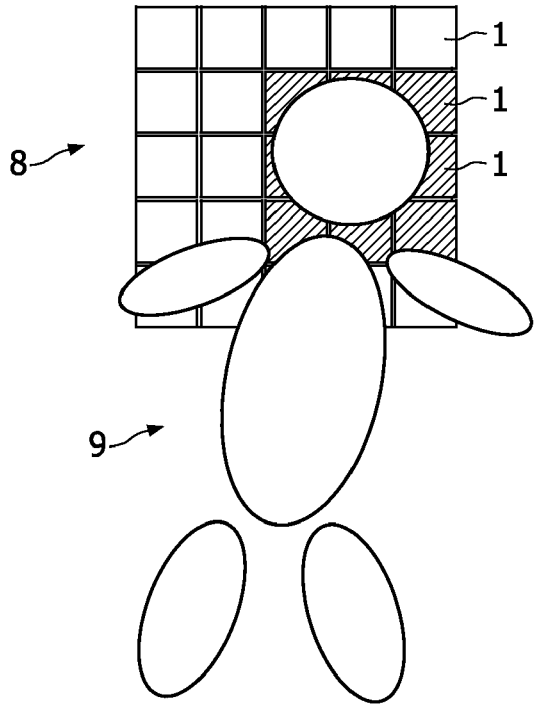
Figure 4:
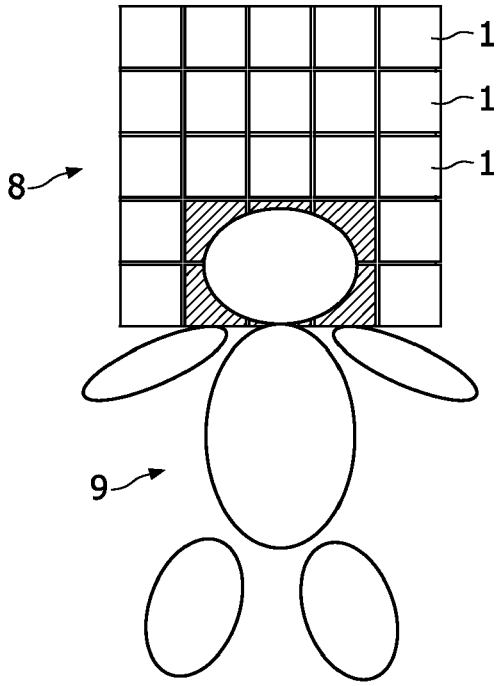

As shown in FIGS. 2 to 4, the mirror according to the preferred embodiment of the invention is comprised of an array 8 of OLEDs 1 which generate a mirror surface which can be selectively illuminated in dependence of the position of a person 9 in front of the mirror. For that, the OLEDs 1 are arranged as capacitive proximity sensors which means that the OLEDs 1 together act as position detector for detecting the person's 9 position in front of the mirror.

The OLEDs 1 are controlled in such a way that the area of the array 8 which is face to face with the person 9 is not illuminated, i.e. the corresponding OLEDs 1 are not activated and are, thus, reflective, while the surrounding area, i.e. the surrounding OLEDs 1 are actuated and, thus illuminated. In FIGS. 2 to 4 OLEDs 1 acting as mirror elements are depicted with a hatched surface area while OLEDs 1 which are illuminated are shown with a clear surface.

This way, the mirror surface and the lighting area can be changed in real-time following the person's 9 movements as shown in FIGS. 2 and 3. Further, the mirror according to the preferred embodiment of the invention is not only arranged for compensating movements of the person 9 in front of the mirror. As can be seen from FIG. 4, even in case of a smaller person 9 in front of the mirror, e.g. in case of a child, optimum illumination and reflection of the face of the person 9 can be achieved. Thus, the invention provides for a versatile mirror with self illumination which is automatically adapted to each type of use.

While the invention has been illustrated and described in detail in the drawings and the foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. Mirror for personal use comprising:

a lighting system for illuminating at least part of a person situated in front of the mirror, and a position detector for detecting the position of the person and transmitting a signal associated with the detected position to the lighting system, wherein the lighting system comprises multiple lighting elements including one or more OLEDs and configured to be actuated independently from each other in dependence of the signal of the position detector, at least one lighting element being configured to perform as a mirror element when not activated.

2. Mirror according to claim 1, wherein the brightness of the lighting elements is controlled independently from each other and in dependence of the signal of the position detector.

3. Mirror according to claim 1, wherein the position detector comprises at least one capacitive proximity sensor.

4. Mirror according to claim 3, wherein at least two lighting elements are configured as capacitive proximity sensors.

5. Mirror according to claim 1, wherein the position detector comprises a video camera.

* * * * *